US010109298B2

(12) United States Patent
Odashima et al.

(10) Patent No.: US 10,109,298 B2
(45) Date of Patent: Oct. 23, 2018

(54) INFORMATION PROCESSING APPARATUS, COMPUTER READABLE STORAGE MEDIUM, AND INFORMATION PROCESSING METHOD

(71) Applicant: FUJITSU LIMITED, Kawasaki-shi, Kanagawa (JP)

(72) Inventors: Shigeyuki Odashima, Tama (JP); Toshikazu Kanaoka, Atsugi (JP); Katsushi Miura, Atsugi (JP); Keiju Okabayashi, Sagamihara (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/361,948

(22) Filed: Nov. 28, 2016

(65) Prior Publication Data

US 2017/0154639 A1 Jun. 1, 2017

(30) Foreign Application Priority Data

Nov. 30, 2015 (JP) ..... 2015-234038

(51) Int. Cl.
*H04R 29/00* (2006.01)
*G10L 25/51* (2013.01)
*G10L 25/27* (2013.01)

(52) U.S. Cl.
CPC ..... *G10L 25/51* (2013.01); *G10L 25/27* (2013.01)

(58) Field of Classification Search
CPC ..... G10L 25/51; G10L 25/27
See application file for complete search history.

(56) References Cited

U.S. PATENT DOCUMENTS 6,290,654 B1 * 9/2001 Karakasoglu ..... A61B 5/087 128/201.23
2013/0281883 A1 * 10/2013 Nishida ..... A61B 5/7282 600/586

FOREIGN PATENT DOCUMENTS

| | | |
|---|---|---|
| JP | 8-329373 | 12/1996 |
| JP | 2000-275096 | 10/2000 |
| JP | 2004-101216 | 4/2004 |
| JP | 2011-237865 | 11/2011 |
| JP | 2013-225248 | 10/2013 |
| JP | 2015-108990 | 6/2015 |

OTHER PUBLICATIONS

"Watch Hot Line", offered by Zojirushi Corporation, http://www.mimamori.net, Nov. 21, 2016.
"Watch Link", offered by Tateyama Kagaku Group, http://www.takeyama.jp/mimamolink/outline.html, Nov. 21, 2016.

* cited by examiner

*Primary Examiner* — Simon King
(74) *Attorney, Agent, or Firm* — Staas & Halsey LLP

(57) ABSTRACT

An information processing apparatus including: a memory, and a processor coupled to the memory and the processor configured to: detect a plurality of sounds in sound data captured in a space within a specified period, classify the plurality of sounds into a plurality of kinds of sound based on similarities of the plurality of sounds respectively, and determine a state of a person in the space within the specified period based on counts of the plurality of kinds of sound.

7 Claims, 12 Drawing Sheets

FIG. 4A

105

| TIME STAMP | FEATURE |
|---|---|
| 2014/6/25 12:30 | (0.12,0.352,0.41,0,⋯) |
| ⋯ | ⋯ |

FIG. 4B

109

| CLUSTER ID | FEATURE | OCCURRENCE FREQUENCY |
|---|---|---|
| 13 | (0.1,0.12,0.1⋯) | 0.00012 |
| ⋯ | ⋯ | ⋯ |

CLUSTER ID:
1
1
2
1
...
SOUND CLUSTER
1
2
3

P-ORDER NORM 1.00
(p=0.1)

2.19

3.48

INFORMATION PROCESSING APPARATUS, COMPUTER READABLE STORAGE MEDIUM, AND INFORMATION PROCESSING METHOD

CROSS-REFERENCE TO RELATED APPLICATION

This application is based upon and claims the benefit of priority of the prior Japanese Patent Application No. 2015-234038, filed on Nov. 30, 2015, the entire contents of which are incorporated herein by reference.

FIELD

The embodiment discussed herein is related to an information processing apparatus, a computer readable storage medium, and an information processing method.

BACKGROUND

With the arrival of aging society, an "elderly watch service" that automatically checks the safety of an elderly person who lives alone is increasingly expected. Typically, the watch service checks the condition of an elderly person by using information from a sensor installed in the home. For example, watching that uses a sensor installed in a water pot ("Watch hot line" offered by Zojirushi Corporation, http://www.mimamori.net), watching under a condition where a plurality of piezoelectric sensors are arranged in the home ("Watch link" offered by Tateyama Kagaku Group, https://www.tateyama.jp/mimamolink/outline.html), and the like are provided as services.

However, among these watching techniques, one that uses a single sensor (for example, a water pot sensor) has a problem in that the detection range over which watching is performed is narrow, and another that uses a plurality of sensors has a problem in that the cost of installing sensors is high.

Accordingly, dealt with here are watching techniques using "sound information" by which a large coverage may be achieved with fewer sensors. Some techniques of detecting unusualness and the like using sound information are known (for example, refer to Japanese Laid-open Patent Publication No. 2011-237865, Japanese Laid-open Patent Publication No. 2004-101216, Japanese Laid-open Patent Publication No. 2013-225248, Japanese Laid-open Patent Publication No. 2000-275096, Japanese Laid-open Patent Publication No. 2015-108990, Japanese Laid-open Patent Publication No. 8-329373, and the like).

In a watching system, it is determined whether a user being watched (a watched user) is in an "active state" or in an "inactive state". Specifically, the "active state" is that, as illustrated on the left side of FIG. 1, a watched user is in their room, and is active on their feet. From the sounds resulting from a person's activity, it may be determined that the person is in an "active state". The "inactive state" refers to a state in which, as illustrated on the right side of FIG. 1, the watched user is not in their room, or, although the watched user is in their room, they are asleep or quiet, producing no sound. From sounds produced by machines (such as a washing machine and a fan) or the like, it may be determined that the person is in an "inactive state".

Such determination of an "active state" or an "inactive state" provides information that is useful for the accomplishment of elderly watch services, such as, for example, detection of a watched user who has fallen down, and detection of a watched user wandering at night. Note that it is desirable that, even when sounds outside the room, for example, when rain or a car produces a sound, the state in which a person is not active in the room be detected as an "inactive" state.

SUMMARY

According to an aspect of the invention, an information processing apparatus includes a memory, and a processor coupled to the memory and the processor configured to: detect a plurality of sounds in sound data captured in a space within a specified period, classify the plurality of sounds into a plurality of kinds of sound based on similarities of the plurality of sounds respectively, and determine a state of a person in the space within the specified period based on counts of the plurality of kinds of sound.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 4A and FIG. 4B are diagrams depicting examples of data structures of a sound feature DB and a sound cluster DB, respectively;

DESCRIPTION OF EMBODIMENT

Figure 1:
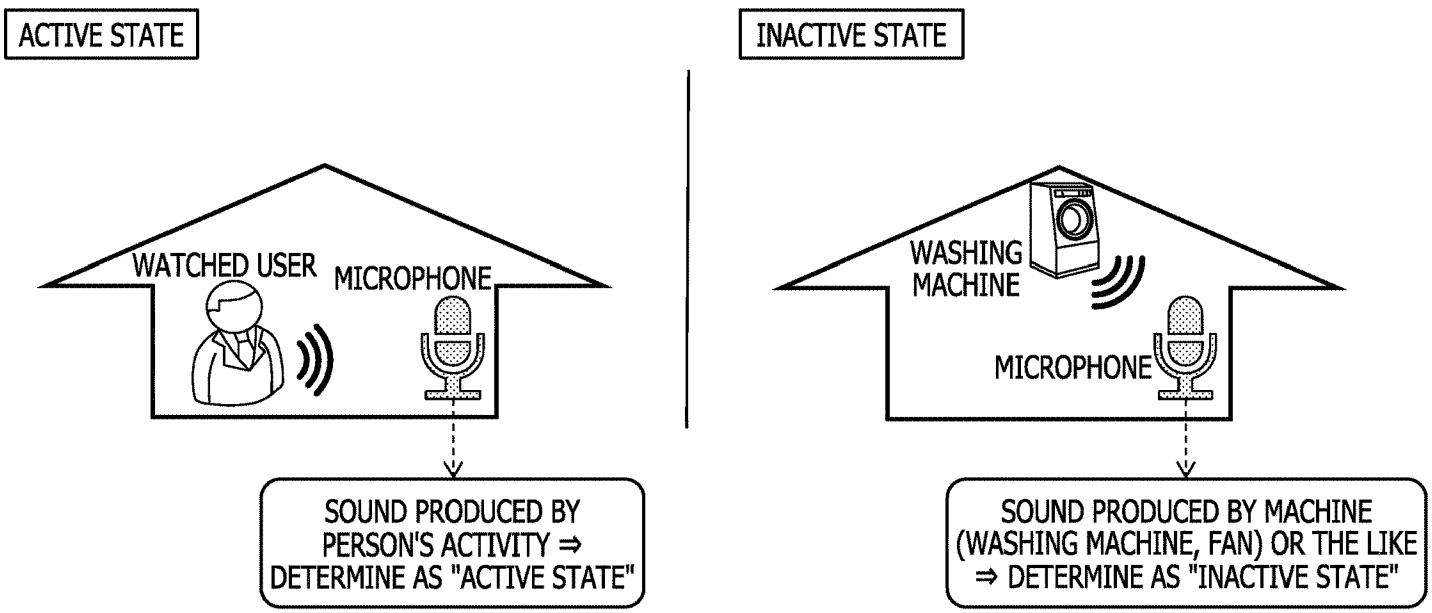
FIG. 1 is a diagram illustrating an example of determination of an active state or an inactive state.

As described above, determination of an "active state" or an "inactive state" provides basic information for an elderly watch service. However, in some cases, a sound resulting from the activity of a person and a sound from the outside are not distinguished from each other. It is desirable that the accuracy of the determination be improved.

Accordingly, in one aspect, an object of the present disclosure is to improve the accuracy of the determination of active states of a person in a space in which a person is likely to be present.

Hereinafter, an embodiment of the present disclosure will be described.

<Detection of Active State or Inactive State>

One method to robustly detect active states by using sounds of everyday life in an indoor environment (hereinafter referred to as everyday life sounds) makes use of the fact that sampling everyday life sounds for a long time period reveals that "sounds particular to human activities" are insignificant. For example, while sounds that are not related to human activities (background sounds), such as the sounds of a refrigerator fan, are continuously produced at all times, sounds related to human activities (activity sounds), such as the sounds of a human conversation and the sounds of washing dishes, are not continuously produced at all times. Therefore, the respective frequencies of both kinds of sounds are assumed in a manner whereby the background sounds are assumed to have high frequencies and the activity sounds are assumed to have low frequencies. Accordingly, an active state may be detected when a large number of activity sounds with low frequencies are detected among learning data.

The "kind of sounds" may be automatically extracted by performing a clustering process. Therefore, everyday life sounds for a long time are accumulated in advance in the home environment and are subjected to a clustering process, and then the frequency for each cluster is calculated and learning processing is performed. At the time of detection, input sounds are associated with clusters and it is thereby determined whether or not the input sounds are activity sounds. Thus, activity sounds may be extracted without including the definition of the "kinds of sounds". For an approach of "an activity is considered as being present if a specific sound is detected" (for example, if "the sound of a cough" is detected, the sound is detected as an "activity"), which is usually used, fine comprehensive definitions (for example, "metal door", "wooden door", and the like) are desired so that the detection is sufficient to distinguish differences in every home environment. In addition, a large amount of sound data corresponding to the fine definitions is desired, and therefore it is actually difficult for the detection to be sufficient to distinguish differences in environments. The above-described method, in which activity sounds are distinguished from background sounds based on the frequencies, makes it possible to avoid defining the kinds of sounds. Thus, this method has an advantage in that the method helps the detection to be sufficient to distinguish differences in environments. Note that, in order to enhance the robustness at the time of activity detection, the number of activity sounds detected for the duration of a certain time (for example, 10 minutes) is counted, and an "activity" is detected when the number of detected activity sounds is larger than or equal to a certain number.

However, the above-described method has a problem in that, for example, as is the case for the sounds of rain, although the frequency is usually low, a large number of sounds with low frequencies are produced regardless of activities in some cases, and such cases are detected by mistake as active states. For example, when the time zone in which a person is absent overlaps the time zone of rain, the overlapping time zone is detected by mistake as an active state. In such a case, it is not possible to accurately detect a state. To comply with the policy of reducing cases where the time zone of rain is detected by mistake as an active state, a method in which learning data including a large amount of "sounds of rain" is provided and the frequency is recalculated is simply conceivable. However, the "sounds of rain" are similar to the "sounds of tap water" among sounds to be dealt with as activity sounds (both are classified into the same category, the "sounds of water", and therefore it is difficult to robustly detect the "sounds of rain" as background sounds. Accordingly, solving a problem by changing learning data is difficult.

In order to avoid the problem described above, a technique will be disclosed in which, in a system of determining an active state of a dweller by using sound information, the active state is determined in such a way that the variety of sounds detected within a certain length of time is used as an index to the active state. The reason for this is as follows. It is expected that while, during, for example, "washing dishes" that is to be regarded as an activity, many kinds of sounds such as the sounds of dishes and the sounds of taps are highly likely to be produced other than the sounds of running water (the sounds of tap water), during rain falling that is to be regarded as background sounds, only the sounds of water (the sounds of rain) are produced if a person is not active. It is therefore expected that, whether or not many kinds of sounds are produced functions as an important clue for distinguishing active sounds from background sounds (inactive sounds).

More particularly, in a system of detecting an active state of a user by using everyday life sounds, an active state is determined based on the variety of sounds within a certain length of time. As an embodiment, the number of types of clusters within a fixed-length time window may be used as the variety of sounds. Through this method, it is possible to inhibit an "active state" from being detected by mistake when a large number of sounds at low frequencies, such as the sounds of rain, are temporarily produced because of the weather or the like. Furthermore, by using the p-order norm ($0<p<1$) of a normalized histogram as the variety of sounds, an activity detection technique with increased robustness is provided. Details of the technique will be described below.

<Configuration>

Figure 2:
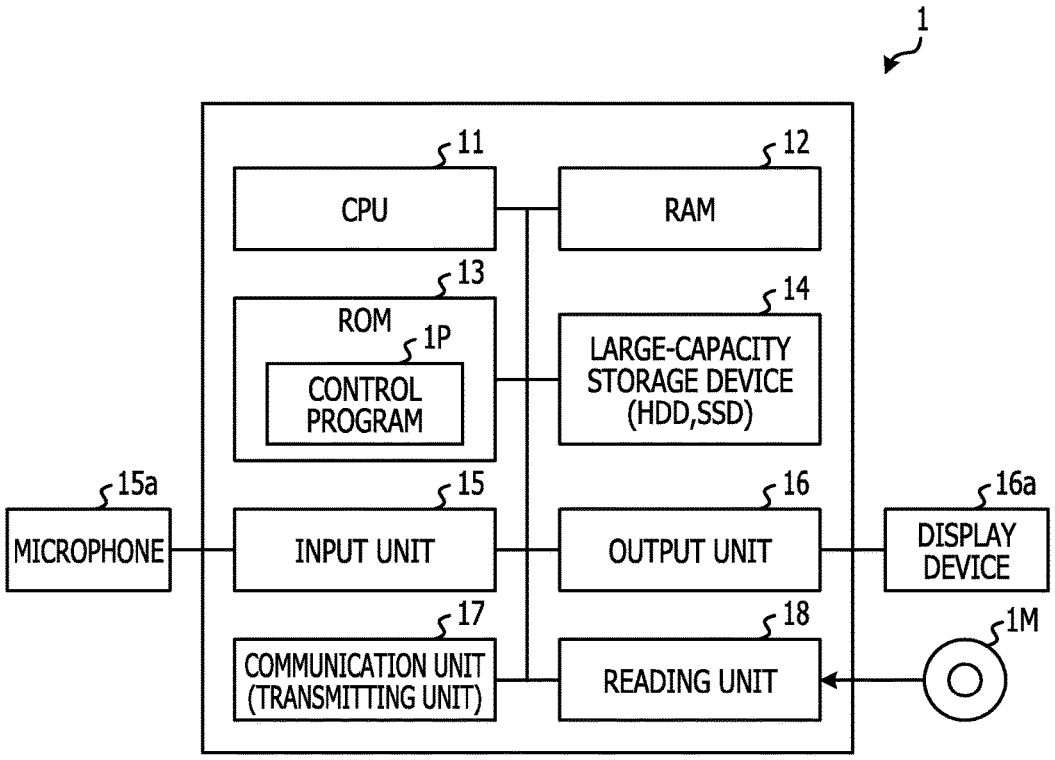
FIG. 2 is a diagram illustrating an example of a hardware configuration of an information processing apparatus.

FIG. 2 is a diagram illustrating an example of a hardware configuration of an information processing apparatus 1 constituting an active state detection apparatus. In FIG. 2, the information processing apparatus 1 is a general-purpose computer, a workstation, a desktop personal computer (PC), a notebook computer, or the like. The information processing apparatus 1 includes a central processing unit (CPU) 11, random access memory (RAM) 12, read-only memory (ROM) 13, a large-capacity storage device 14, an input unit 15, an output unit 16, a communication unit (a transmission unit) 17, and a reading unit 18. All of the components are coupled by a bus.

The CPU 11 controls each unit of hardware in accordance with a control program 1P stored in the ROM 13. The RAM 12 is, for example, static RAM (SRAM), dynamic RAM (DRAM), flash memory, or the like. The RAM 12 temporarily stores data that is used during execution of programs by the CPU 11.

The large-capacity storage device 14 is, for example, a hard disk drive (HDD), a solid state drive (SSD), or the like. In the large-capacity storage device 14, various types of databases described below are stored. In addition, the control program 1P may be stored in the large-capacity storage device 14.

The input unit 15 includes a keyboard, a mouse, and the like for inputting data to the information processing apparatus 1. In addition, for example, a microphone 15*a* that captures everyday life sounds is coupled, and everyday life sounds captured by the microphone 15*a* are converted into electrical signals and are input to the input unit 15. Note that, herein, "sound" is not limited to "sound" in a narrow sense, which is obtained by acquiring vibrations in the air by using a microphone, but is an concept in a wide sense including cases where "vibrations" that propagate through the air, through a substance, and through liquid are measured by, for example, a microphone or a measurement device, such as a piezoelectric element or a laser small displacement meter.

The output unit 16 is a component for providing an image output of the information processing apparatus 1 to a display device 16*a* and a sound output to a speaker or the like.

The communication unit 17 performs communication with another computer via a network. The reading unit 18 performs reading from a portable recoding medium 1M including compact disk (CD)-ROM or digital versatile disc (DVD)-ROM. The CPU 11 may read the control program 1P from the portable storage medium 1M, through the reading unit 18, and store the control program 1P in the large-capacity storage device 14. In addition, the CPU 11 may download the control program 1P from another computer via a network and store the control program 1P in the large-capacity storage device 14. Furthermore, the CPU 11 may read the control program 1P from semiconductor memory.

Figure 3:
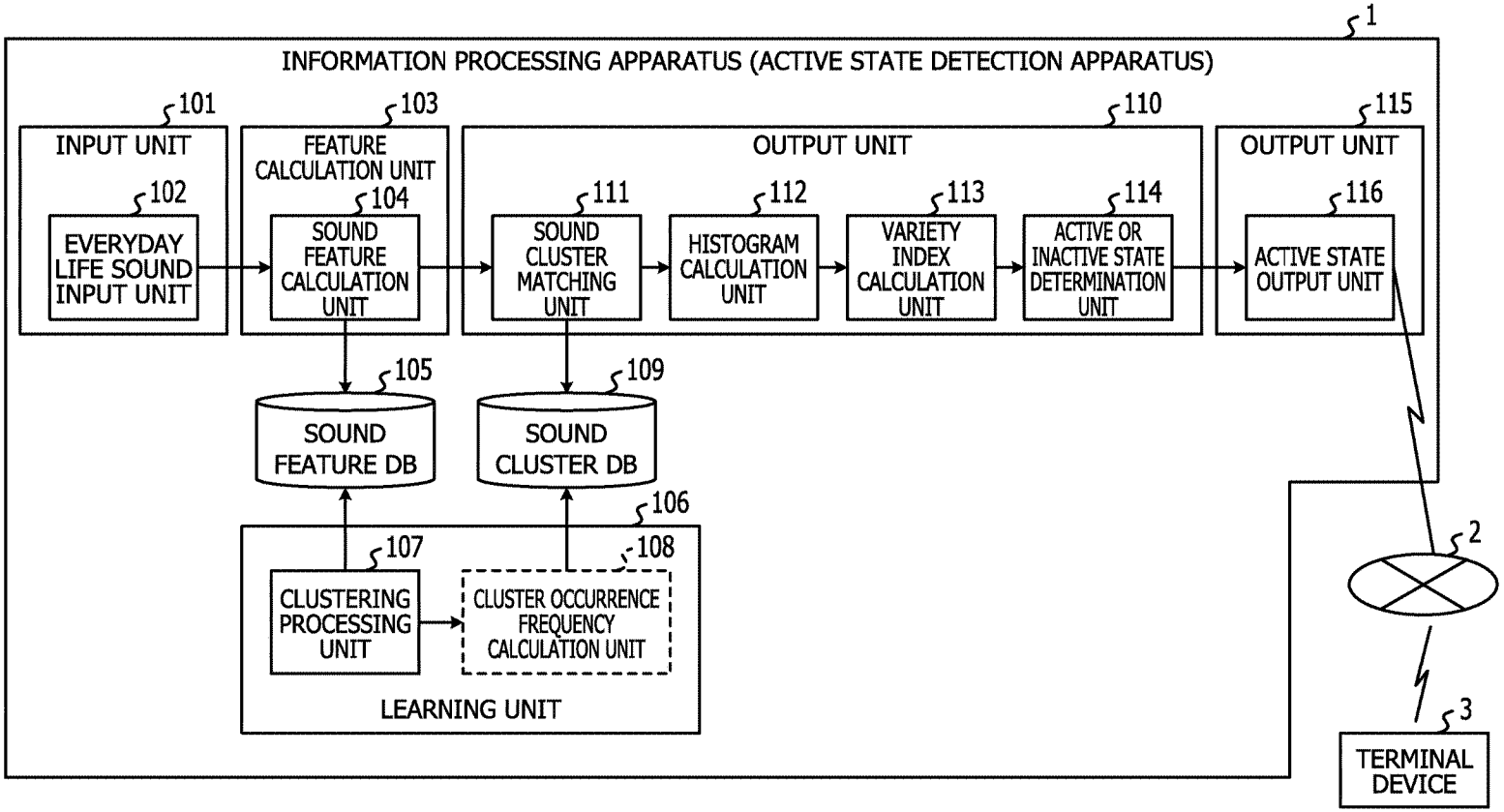
FIG. 3 is a diagram illustrating an example of a software configuration of the information processing apparatus.

FIG. 3 is a diagram illustrating an example of a software configuration of the information processing apparatus 1. In conjunction with FIG. 3, the information processing apparatus 1 includes an input unit 101, a feature calculation unit 103, a sound feature DB 105, a learning unit 106, a sound cluster DB 109, an active state determination unit 110, and an output unit 115. The input unit 101 includes an everyday life sound input unit 102. The feature calculation unit 103 includes a sound feature calculation unit 104. The learning unit 106 includes a clustering processing unit 107 and a cluster occurrence frequency calculation unit 108. The active state determination unit 110 includes a sound cluster matching unit 111, a histogram calculation unit 112, a variety index calculation unit 113, an active or inactive state determination unit 114. The output unit 115 includes an active state output unit 116.

The everyday life sound input unit 102 of the input unit 101 acquires sounds captured by the microphone 15*a* as data (sound data). In addition, the everyday life sound input unit 102 delivers sound data to the feature calculation unit 103.

The sound feature calculation unit 104 of the feature calculation unit 103 separates sound data by time windows and calculates a feature representing an acoustic feature for each separated time length. The calculated feature is stored in the sound feature DB 105.

FIG. 4A depicts an example of a data structure of the sound feature DB 105. The sound feature DB 105 contains columns of time stamps and features. In the time stamp column, time stamps of sound data are stored. In the feature column, the values of features of sound data are stored. The values that may be used as features of sound data include the following: the sound waveform itself, the value obtained by applying a filter to a sound waveform (for example, inputting a sound waveform to a model of deep learning), the frequency spectrum of sound (the value obtained by applying fast Fourier transform (FFT) to a sound waveform), the Mel spectrum feature (spectrum), the Mel-frequency cepstral coefficient (MFCC) feature (cepstrum), the perceptual linear prediction (PLP) feature (cepstrum), the zero-crossing rate (the number of times a sound waveform crosses the zero point), the sound volumes (the average, the largest value, an effective value, and the like), and so on.

Returning to FIG. 3, the clustering processing unit 107 of the learning unit 106 performs a clustering process of features stored in the sound feature DB 105 at each given time interval, at each time at which the sound feature DB 105 is updated, or the like. The cluster occurrence frequency calculation unit 108 calculates the frequency of occurrences of each cluster and stores the calculated frequency in the sound cluster DB 109. Note that the frequency of occurrences of each cluster may be used to distinguish activity sounds from background sounds; however, the calculation may be skipped when activity sounds and background sounds do not have to be distinguished in the subsequent processing.

FIG. 4B depicts an example of a data structure of the sound cluster DB 109. The sound cluster DB 109 contains columns of cluster identifiers (IDs), features, and occurrence frequencies. In the cluster ID column, IDs that identify clusters, respectively, are stored. In the feature column, the feature of each cluster, that is, the representative of each cluster, such as the center coordinates of the cluster or the median of data included in the cluster, is stored. In the occurrence frequency column, the frequency of occurrences of each cluster is stored. If calculation of frequencies of occurrences is skipped, the item of occurrence frequencies disappears.

Returning to FIG. 3, the sound cluster matching unit 111 of the active state determination unit 110 performs matching between a feature received from the sound feature calculation unit 104 at the time of detection, and a feature of each cluster stored in the sound cluster DB 109, determines a cluster to which a sound being processed is to be belong, and outputs the ID of the cluster.

The histogram calculation unit 112 counts the number of occurrences for each of IDs of clusters that occur within a given time. The variety index calculation unit 113 calculates the index to the variety of sounds from the number of occurrences for each of IDs of clusters counted by the histogram calculation unit 112. Details of the index to the variety of sounds will be described below. The active or inactive state determination unit 114 determines from the value of the index to the variety of sounds calculated by the variety index calculation unit 113 whether an active state or an inactive state is present.

The active state output unit 116 of the output unit 115 outputs the "active state" or "inactive state" determined by the variety index calculation unit 113 of the active state determination unit 110 to the outside. For example, the active state output unit 116 notifies a terminal device 3 (a smart phone, a PC, or the like) at an address registered in advance, via the network 2, of the "active state" or "inactive state".

Note that, in conjunction with FIG. 3, a so-called stand-alone configuration has been described as the information processing apparatus 1; however, part of functions may be in a cloud configuration (a configuration that makes use of processing of a server on a network). The input unit 101 is strongly related to the microphone 15*a* that is physically installed, and therefore arbitrary portions of processing of the feature calculation unit 103 and the subsequent components may be left to the cloud part.

<Operations>

Figure 5:
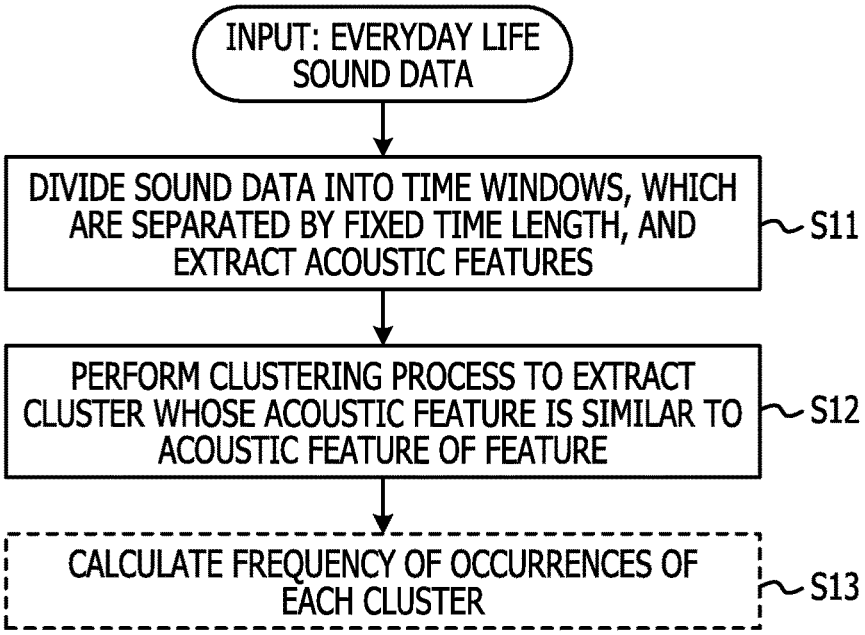
FIG. 5 is a flowchart illustrating an example of processing at the time of learning.

FIG. 5 is a flowchart illustrating an example of processing at the time of learning. In conjunction with FIG. 5, sound data that is output in real time from the everyday life sound input unit 102 of the input unit 101 or sound data accumulated in advance is input to the sound feature calculation unit 104 of the feature calculation unit 103. Then, the sound feature calculation unit 104 divides the sound data into segments of time windows, which are separated by a fixed length of time, extracts acoustic features, and stores their features in the sound feature DB 105 (S11).

Next, the clustering processing unit 107 of the learning unit 106 performs a clustering process based on a feature stored in the sound feature DB 105 to extract a cluster whose acoustic feature is similar to the acoustic feature represented by the feature (S12).

Next, the cluster occurrence frequency calculation unit 108 calculates the frequency of occurrences of each cluster (S13). The extracted clusters and their frequencies of occurrences are stored in the sound cluster DB 109.

Figure 6:
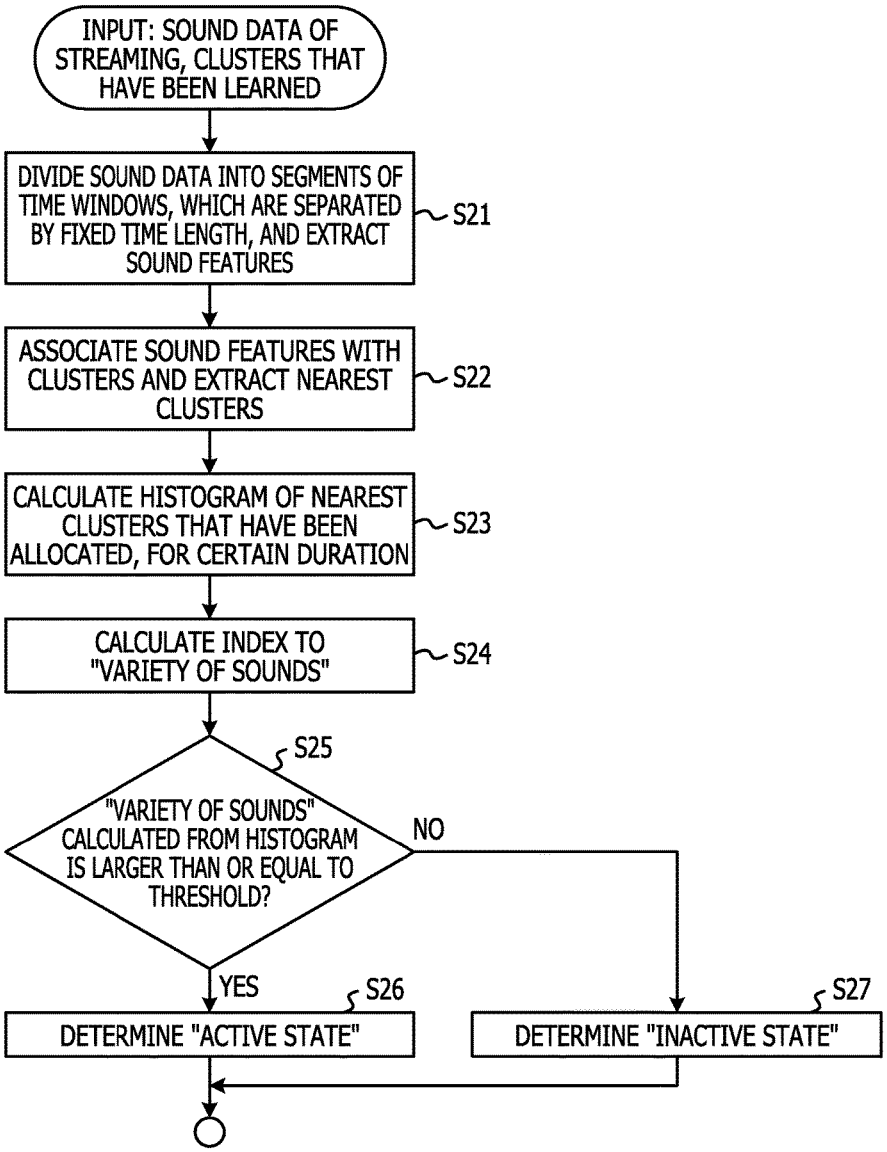
FIG. 6 is a flowchart illustrating an example of processing at the time of determination.
Figures 7A, 7B, 7C:
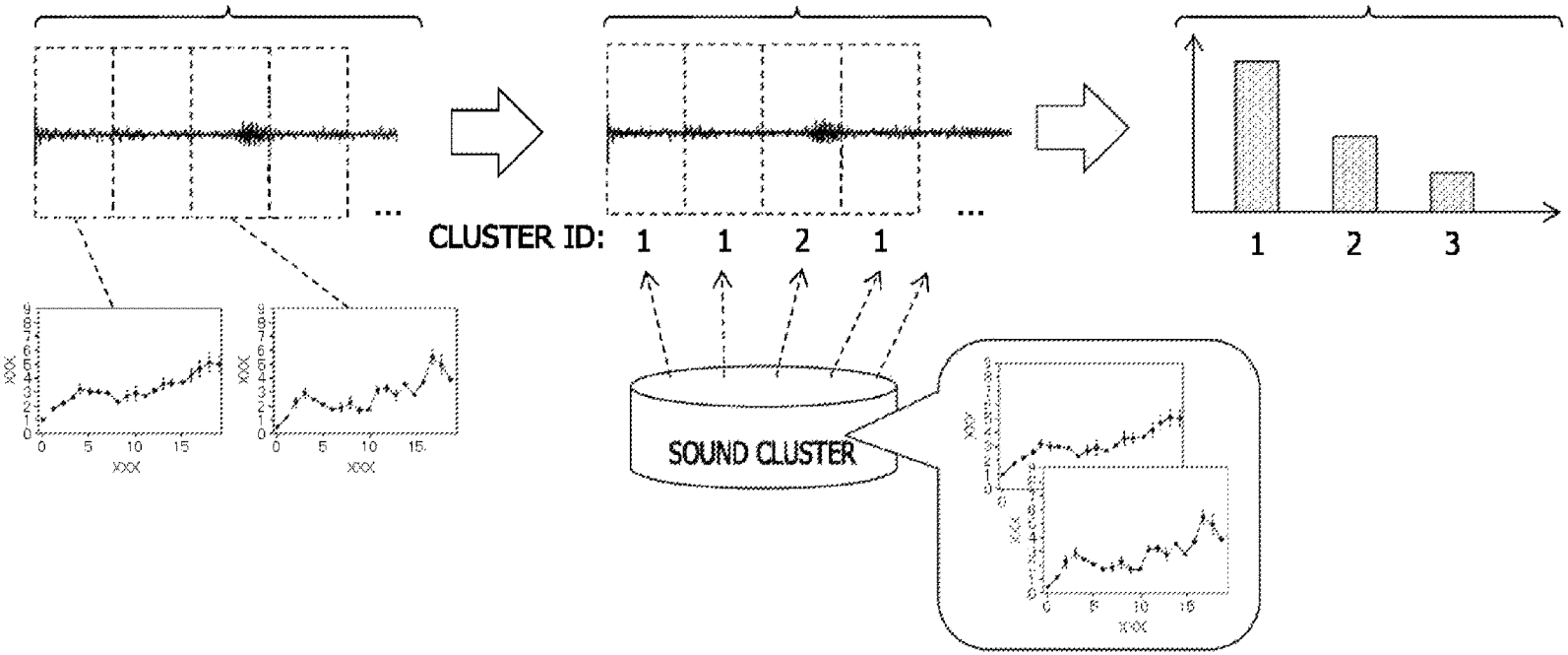
FIGS. 7A to 7C are diagrams illustrating an example of processing at the time of determination.

FIG. 6 is a flowchart illustrating an example of processing at the time of determination. In conjunction with FIG. 6, sound data that is output in real time from the everyday life sound input unit 102 of the input unit 101 and clusters that have been learned (the sound cluster DB 109) are input to the sound feature calculation unit 104 of the feature calculation unit 103. Then, the sound feature calculation unit 104 divides the sound data into segments of time windows, which are separated by a fixed length of time, extracts acoustic features, and delivers their features to the active state determination unit 110 (S21). FIG. 7A illustrates a manner in which features are extracted from sound data.

Next, returning to FIG. 6, the sound cluster matching unit 111 of the active state determination unit 110 performs association (matching) with clusters stored in the sound cluster DB 109 based on the acoustic features represented by the features delivered from the feature calculation unit 103, and extracts the nearest clusters (S22). FIG. 7B illustrates a manner in which matching of the features with clusters is performed.

Next, returning to FIG. 6, the histogram calculation unit 112 calculates a histogram of the allocated nearest clusters for a certain duration (S23). FIG. 7C illustrates an example of a histogram representing the respective frequencies of clusters.

Next, returning to FIG. 6, the variety index calculation unit 113 calculates the index to "the variety of sounds" based on the histogram (S24). Note that occurrences of clusters based on activity sounds and occurrences of clusters based on background sounds are included in the histogram, and, without distinguishing both of them from each other, the index to "the variety of sounds" may be calculated, or the index to "the variety of sounds" may be calculated based only on the occurrences of clusters based on activity sounds. To distinguish activity sounds from background sounds, the frequency of occurrences of each cluster calculated by the cluster occurrence frequency calculation unit 108 may be used. Details of calculation of the index to "the variety of sounds" will be described below.

Next, the active or inactive state determination unit 114 determines whether or not the index to "the variety of sounds" is larger than or equal to a given threshold (S25). If so, (Yes in S25), an "active state" is determined (S26). If not (No in S25), an "inactive state" is determined (S27).

Example (1) of Calculation of Index to Variety of Sounds

Figure 8:
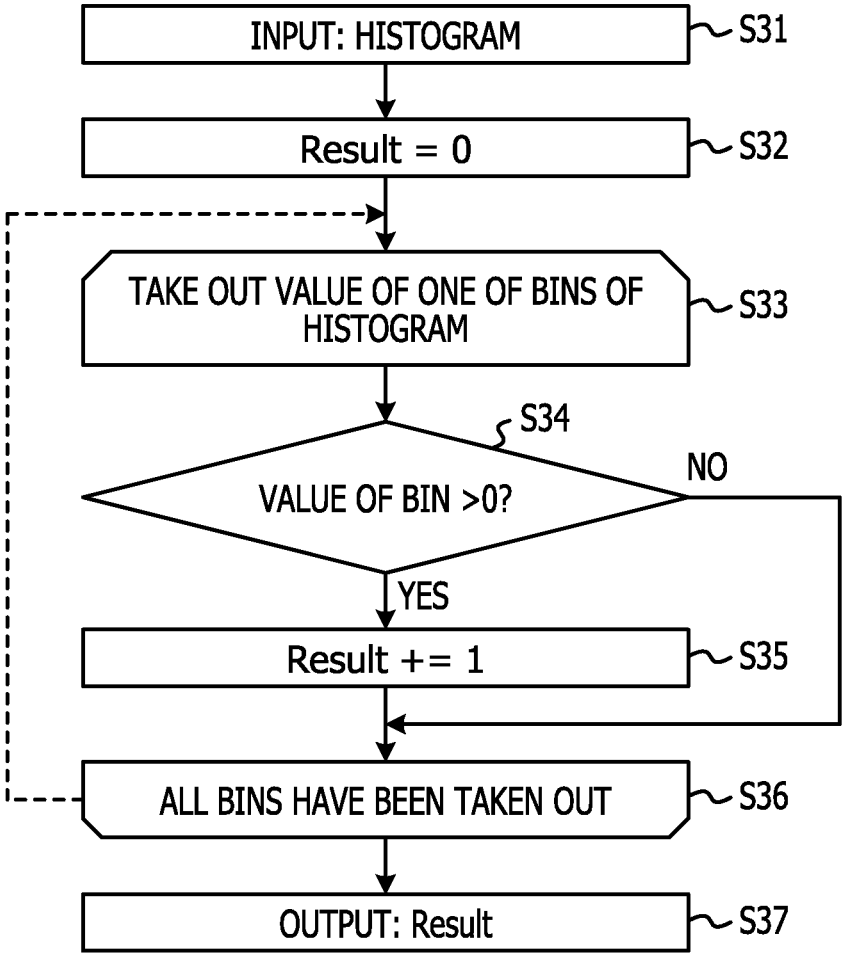
FIG. 8 is a flowchart (1) illustrating an example of processing of calculation of an index to "the variety of sounds"

FIG. 8 is a flowchart illustrating an example of processing of calculation of an index to "the variety of sounds", and the number of types of clusters within a fixed-length time window (the number of clusters in which one or more occurrences are present within the time window of a fixed length of time) is obtained as an index to the variety of sounds.

In conjunction with FIG. 8, a histogram calculated by the histogram calculation unit 112 is input to the variety index calculation unit 113 (S31), and the variety index calculation unit 113 sets a variable Result to "0" (S32).

Next, the variety index calculation unit 113 takes out the value of one of bins of the histogram (S33), and determines whether or not the value of the bin is larger than zero (S34).

Upon determining that the value of the bin is larger than zero (Yes in S34), the variety index calculation unit 113 increments (adds one to) the variable Result (S35).

Upon determining that the value of the bin is not larger than zero (No in S34) and after incrementing the variable Result (S35), the variety index calculation unit 113 determines that all of the bins of the histogram have been taken out (S36), and, if not, repeats the process from the step of taking out the value of one of the bins of the histogram (S33). If all of the bins of the histogram have been taken out, the variety index calculation unit 113 outputs the variable Result as the index to the variety of sounds (S37).

Example (2) of Calculation of Index to Variety of Sounds

Figure 9A:
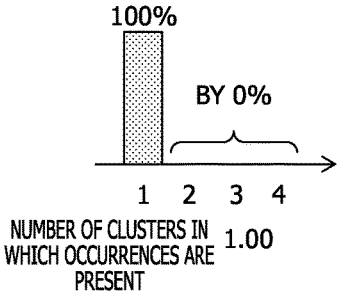
FIGS. 9A to 9C are diagrams (1) illustrating examples of a relationship between occurrences of clusters and indices on a histogram.
Figure 9B:
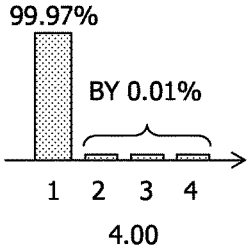
Figure 9C:
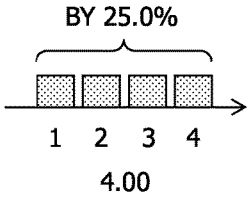

When, as described above, the number of types of clusters within the fixed-length time window is an index to the variety of sounds, there is a vulnerability if noise is included in sound data that is input. FIGS. 9A to 9C illustrate examples in each of which the number of clusters in which occurrence are present is calculated from a histogram. FIG. 9A illustrates the case where occurrences are centered on one cluster (the number of clusters in which occurrences are present: one), and FIG. 9C illustrates the case where occurrences are equally distributed among four clusters (the number of clusters in which occurrences are present: four). In these cases, the numbers of clusters in which occurrences are present have values that are significantly different.

However, FIG. 9B illustrates the case where, while most of the occurrences are centered on one cluster, other clusters have a very small number of occurrences. This is intuitively to lead to a value that is substantially intermediate between the value of the case illustrated in FIG. 9A and the value of the case illustrated in FIG. 9C. However, in the case of FIG. 9B, the number of clusters in which occurrences are present is "4", which is the same as in the case of FIG. 9C where occurrences are equally distributed among four clusters. Accordingly, this calculation method does not make it possible to distinguish "the case where although occurrences are centered on a particular cluster, other clusters have a very small number of occurrences" from "the case where occurrences are equally present in all the clusters", and thus is strongly affected by a noise sound when the noise sound has suddenly and unexpectedly produced.

To address this issue, a technique using, as an index to the variety of sound, a p-order norm in which the number of orders of a histogram of clusters is less than one is disclosed. The p-order norm is calculated by $\|x\|_p=|x_1|^p+|x_2|^p+\ldots+|x_n|^p$, where $x_i$ is the value of the i-th bin of the histogram.

With the p-order norm, a value that largely reflects the number of non-zero elements and reflects the magnitude of each element is output. Therefore, it is made possible to output different values between "the case where although the occurrences are centered on a particular cluster, other clusters have a very small number of occurrences" and "the case where occurrences are equally present in all the clusters".

Figure 10:
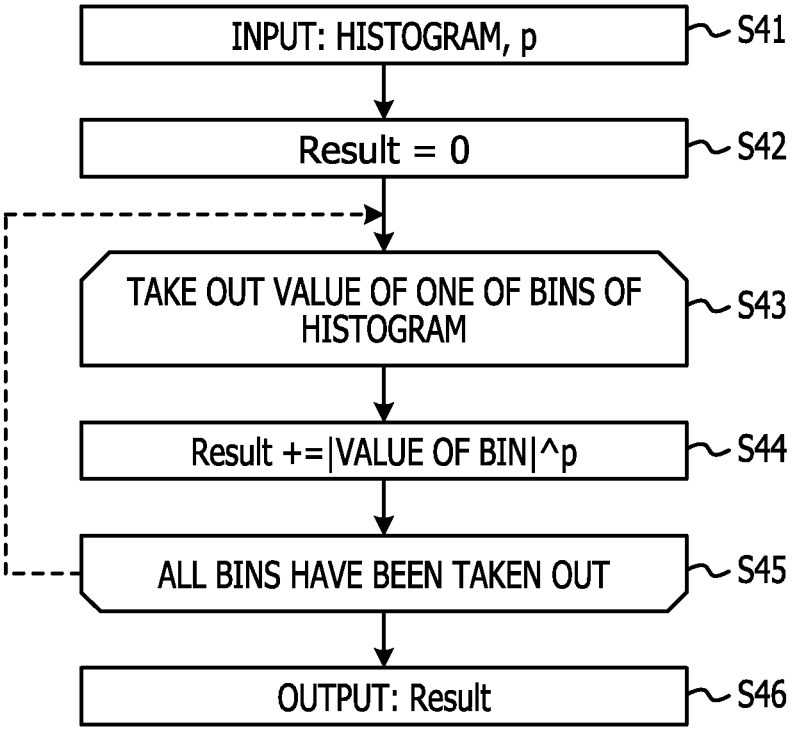
FIG. 10 is a flowchart (2) illustrating an example of processing of calculation of an index to "the variety of sounds"

FIG. 10 is a flowchart illustrating an example of processing of calculating an index to "the variety of sounds" by using the p-order norm. In conjunction with FIG. 10, a histogram calculated by the histogram calculation unit 112 is input to the variety index calculation unit 113 (S41) and the variety index calculation unit 113 sets the variable Result to "0" (S42).

Next, the variety index calculation unit 113 takes out the value of one of the bins of the histogram (S43) and adds a value obtained by multiplying the value of the bin by p to the variable Result (S44).

Next, the variety index calculation unit 113 determines whether or not all the bins of the histogram have been taken out (S45), and, if not, repeats the process from the step of taking out the value of one of the bins of the histogram (S43). If all the bins of the histogram have been taken out, the variety index calculation unit 113 outputs the variable Result as an index to the variety of sounds (S46).

Figure 11A:
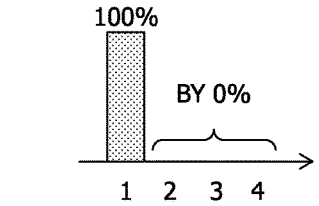
FIGS. 11A to 11C are diagrams (2) illustrating examples of a relationship between occurrences of clusters and indices on a histogram.
Figure 11B:
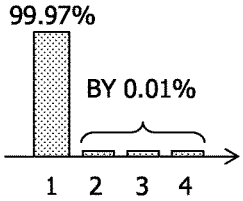
Figure 11C:
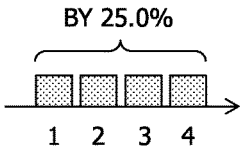

FIGS. 11A to 11C are diagrams illustrating examples of the relationship between the occurrences of clusters and an index on a histogram, where p=0.1. The histogram is the same as in the cases of the number of occurrences in clusters illustrated in FIGS. 9A to 9C. While the same value is output in the examples of FIG. 9B and FIG. 9C, different values of the p-order norm are output in the examples of FIG. 11B and FIG. 11C. Thus, it is found that the robustness against noise is increased.

[Example of Determination of Active States]

Figure 12A:
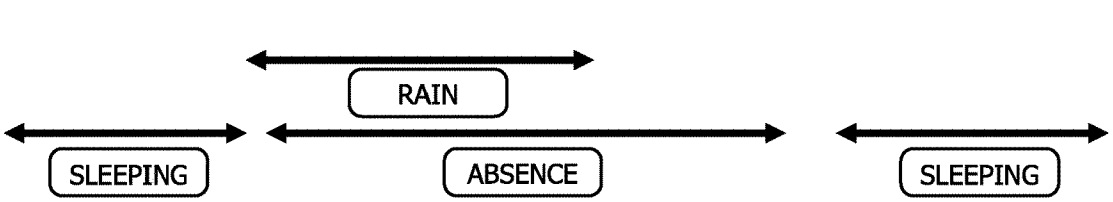
FIGS. 12A to 12C are diagrams depicting an example of determination of an active state.
Figure 12B:
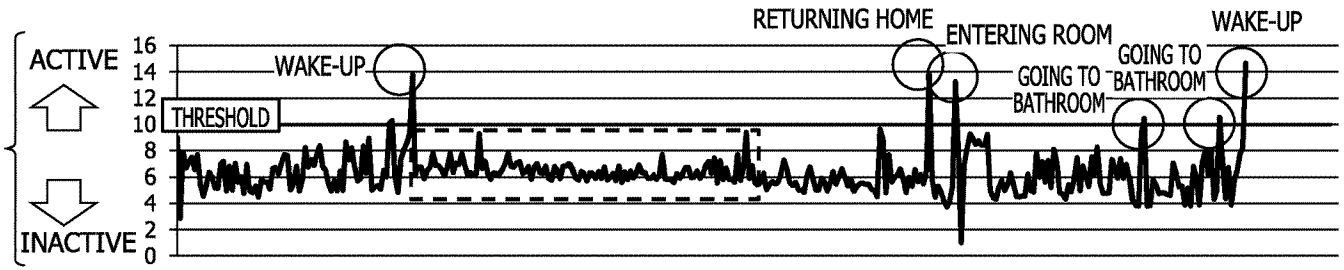
Figure 12C:
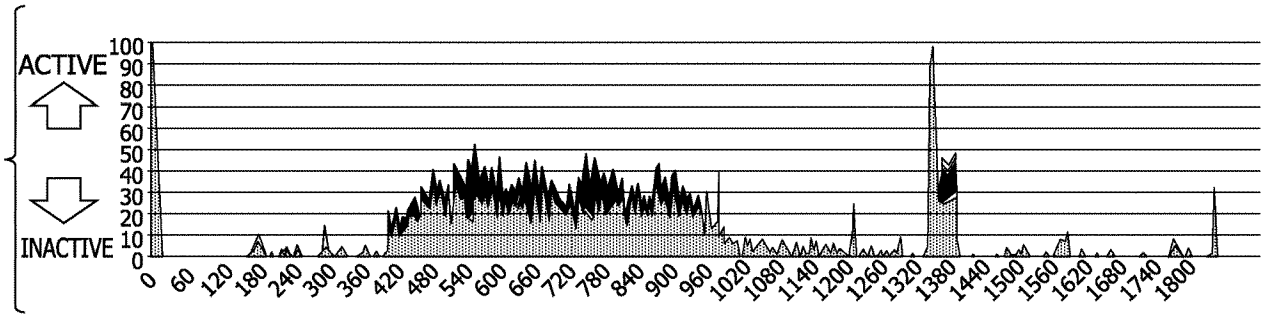

FIGS. 12A to 12C are diagrams illustrating an example of determination of active states, and, in the diagrams, time is assumed to pass in the lateral direction, from left to right. It is assumed that, as illustrated in FIG. 12A, the watched user is in states of sleeping->absence->sleeping and rain falls in the first half of the absence.

FIG. 12B illustrates changes in the index to the variety of sounds using the p-order norm, and active states are detected at the time points at which the index exceeds a given threshold (wake-up, returning home, entering room, going to the bathroom, wake-up). Note that, for the case using the number of types of clusters in which occurrences are present, changes in the index are similar although noise sounds slightly affect the changes.

FIG. 12C illustrates changes in the number of feature sounds determined as activity sounds based on the frequencies within a given time, for the purpose of comparison. Although active states, such as returning home and entering room, are accurately detected, the sounds of rain are determined as activity sounds in the time zone of rain, resulting in a high activity index. Therefore, an active state is highly likely to be detected by mistake although the watched user is absent. In this regard, in FIG. 12B, the index is maintained to be low in the time zone of rain, and the index is high at points at which an activity, such as returning home or entering room, is to be detected. Thus, it is found that activities are able to be robustly detected.

<Recapitulation>

As described above, according to the present embodiment, it is possible to improve the accuracy in determination of active states of a person in a space in which the person is likely to be present.

As discussed above, description has been given by way of an embodiment. Although description has been given here with particular examples, it will be apparent to those skilled in the art that various modifications and changes may be made to these examples without departing from the broad spirit and scope defined in the claims. That is, the present disclosure is not to be construed as limited to the details of the particular examples or the accompanying drawings.

The everyday life sound input unit 102 is an example of an "acquisition unit". The sound feature calculation unit 104 is an example of an "extraction unit". The sound cluster matching unit 111 is an example of an "identification unit". The histogram calculation unit 112 and the variety index calculation unit 113 are an example of a "counting unit". The active or inactive state determination unit 114 is an example of a "determination unit". The active state output unit 116 is an example of a "notification unit".

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An information processing apparatus comprising:

a memory; and a processor coupled to the memory and the processor configured to:

detect a plurality of sounds in sound data captured in a space within a specified period;

classify the plurality of sounds into groups based on similarities of the plurality of sounds respectively; and determine a state of a person in the space within the specified period based on a total number of groups that the plurality of sounds are classified into.

2. The information processing apparatus according to claim 1, wherein the state of the person in the space within the specified period is determined based on percentages of the groups.

3. The information processing apparatus according to claim 1, wherein the state of the person in the space within the specified period is determined based on p-order norms of counts of the groups.

4. The information processing apparatus according to claim 1, wherein the processor is configured to notify a specified terminal device of the state of the person in the space within the specified period.

5. The information processing apparatus according to claim 1, wherein the state of the person is either active or not.

6. A non-transitory computer readable storage medium that stores an information processing program that causes a computer to execute a process comprising:

detecting a plurality of sounds in sound data captured in a space within a specified period;

classifying the plurality of sounds into groups based on similarities of the plurality of sounds respectively; and determining a state of a person in the space within the specified period based on a total number of groups that the plurality of sounds are classified into.

7. An information processing method comprising:

detecting a plurality of sounds in sound data captured in a space within a specified period;

classifying the plurality of sounds into groups based on similarities of the plurality of sounds respectively; and determining, by a computer, a state of a person in the space within the specified period based on a total number of groups that the plurality of sounds are classified into.

* * * * *